US006526623B1

(12) United States Patent
Dyson

(10) Patent No.: US 6,526,623 B1
(45) Date of Patent: Mar. 4, 2003

(54) HANDLE FOR A VACUUM CLEANER

(75) Inventor: James Dyson, Wiltshire (GB)

(73) Assignee: Notetry Limited (GB)

( * ) Notice: Subject to any disclaimer, the term of this patent is extended or adjusted under 35 U.S.C. 154(b) by 0 days.

(21) Appl. No.: 09/581,766

(22) PCT Filed: Dec. 17, 1998

(86) PCT No.: PCT/GB98/03815

§ 371 (c)(1),
(2), (4) Date: Aug. 21, 2000

(87) PCT Pub. No.: WO99/30605

PCT Pub. Date: Jun. 24, 1999

(30) Foreign Application Priority Data

Dec. 17, 1997 (GB) ..... 9726669

(51) Int. Cl.[7] ..... A47L 9/32
(52) U.S. Cl. ..... 15/334; 15/335; 15/331; 15/410
(58) Field of Search ..... 15/334, 335, 323, 15/410, 331

(56) References Cited

U.S. PATENT DOCUMENTS

| | | | | | |
|---|---|---|---|---|---|
| 2,867,833 | A | * | 1/1959 | Duff | 15/410 |
| 3,879,797 | A | * | 4/1975 | Principe et al. | 15/334 |
| 4,443,910 | A | | 4/1984 | Fitzwater | 15/337 |
| 4,519,113 | A | * | 5/1985 | Hipple | 15/335 |
| 4,571,772 | A | * | 2/1986 | Dyson | 15/335 |
| 4,573,236 | A | | 3/1986 | Dyson | 15/333 |
| 4,723,338 | A | * | 2/1988 | Otsubo | 15/331 |
| 4,761,850 | A | * | 8/1988 | Romeo et al. | 15/323 |
| 4,955,106 | A | * | 9/1990 | Stein et al. | 15/335 |
| 4,959,885 | A | * | 10/1990 | Sovis et al. | 15/335 |
| 5,016,315 | A | | 5/1991 | Bledsoe et al. | 15/410 |
| 5,142,731 | A | * | 9/1992 | Resch | 15/323 |
| 5,331,715 | A | * | 7/1994 | Johnson et al. | 15/323 |
| 5,797,162 | A | * | 8/1998 | Vystrcil et al. | 15/323 |
| 5,867,862 | A | * | 2/1999 | Ahlf et al. | 15/410 |

FOREIGN PATENT DOCUMENTS

| | | | |
|---|---|---|---|
| EP | 0 134 654 | * | 3/1985 |
| EP | 0 887 040 A1 | | 12/1998 |

* cited by examiner

*Primary Examiner*—Theresa T. Snider
(74) *Attorney, Agent, or Firm*—Morrison & Foerster LLP

(57) ABSTRACT

A handle for a vacuum cleaner includes a generally rigid pipe portion connected to a generally flexible hose portion. The hose portion is fixedly connected to the main body of the vacuum cleaner. The pipe portion is selectively connectable to the main body of the vacuum cleaner in the manner of a handle or releasable from the main body in the manner of a wand. The pipe portion is formed by a straight, hollow tube having no internal bends. The handle may have an upwardly extending handle portion and a gripping portion, wherein the gripping portion extends forwardly and downwardly from the handle portion so that, when the vacuum cleaner is in use in an upright mode, the gripping portion extends generally transverse to the forearm of the user. A cap may also be provided at the distal end of the rigid pipe portion, the cap being movable between a first position in which the end of the pipe portion is closed by the cap and a second position in which the end of the pipe portion is not closed by the cap.

12 Claims, 3 Drawing Sheets

HANDLE FOR A VACUUM CLEANER

FIELD OF INVENTION

Background of the Invention

The present invention relates to a handle for a vacuum cleaner.

An upright vacuum cleaner generally comprises a cleaner head rotatably mounted to the lower end of the main body of the vacuum cleaner which houses the dust separation apparatus, which can take the form of a bag, a cyclonic separator, or any suitable separation apparatus. The cleaner head has a downwardly directed dirty air inlet through which dirty air is sucked into the dust separation apparatus. This type of vacuum cleaner is often convertible between an upright mode and a cylinder mode.

In the upright mode, the vacuum cleaner is moved over the surface to be cleaned so that the dirty air enters the dust separation apparatus via the dirty air inlet in the cleaner head whilst the main body is inclined rearwardly. The vacuum cleaner comprises an upwardly extending handle which the user can use to move the vacuum cleaner over the surface to be cleaned.

In the cylinder mode, the main body is put into an upright position and a hose or wand, which is fixedly connected to the main body of the vacuum cleaner, is used to introduce dirty air to the dust separation apparatus for above-floor cleaning.

One known type of upright vacuum cleaner, for example disclosed by BP 134654, comprises a wand having a generally rigid pipe portion and a generally flexible hose portion. The hose portion is fixedly connected to the main body of the vacuum cleaner and the rigid pipe portion is selectively connectable to the main body of the vacuum cleaner whilst remaining in telescoping connection with the hose portion. In the cylinder mode, the rigid pipe portion is connected to the main body of the vacuum cleaner via the flexible hose. This allows the user to grip the rigid pipe portion and to maneuver it freely with respect to the main body. Tools such as a nozzle or brush are attached to the distal end of the rigid pipe portion which then forms the dirty air inlet of the vacuum cleaner for above-floor cleaning. In the upright mode, the rigid pipe portion is slid telescopically inside the hose portion and clipped to the back of the main body of the vacuum cleaner so that the rigid pipe portion extends upwardly from the main body to form a handle. The user can then grasp the handle to move the cleaner head over the surface to be cleaned.

The distal end of the rigid pipe portion is bent rearwardly towards the user to provide a more comfortable gripping portion when the vacuum cleaner is used in the upright mode. However, such an inclined gripping portion can allow blockages to occur. Also, the rearward inclination of the distal end of the rigid pipe portion makes it difficult to see whether the pipe portion is blocked and to clear any blockage when the cleaner is being used in the cylinder mode.

An object of the present invention is to provide a wand for a vacuum cleaner in which the risk of blockage is reduced and visual access to allow checking for blockages is improved.

SUMMARY OF THE INVENTION

The present invention provides a handle for a vacuum cleaner comprising a rigid pipe portion connected to a flexible hose portion, the hose portion being fixedly connected to the main body of the vacuum cleaner, the pipe portion being selectively connectable to the main body of the vacuum cleaner in the manner of a handle or releasable from the main body in the manner of a wand and having a free distal end and a proximal end, the distal end forming a dirty air inlet of the vacuum cleaner, characterised in that the pipe portion is formed by a straight, hollow tube having no internal bends between the free distal end and the proximal end.

Since the rigid pipe portion is formed by a straight, hollow tube, it is possible to see down the pipe portion to check whether it is blocked. This can easily be done by detaching the rigid pipe portion from the flexible hose portion and holding the pipe portion up to the light. Since there are no internal bends in the pipe portion, light will pass through the pipe portion if it is not blocked. Furthermore, since the dirty air flows along a straight path, there is less risk of blockage.

Preferably, the handle has an upwardly extending handle portion and a gripping portion extending forwardly and downwardly from the handle portion so that, when the vacuum cleaner is in use in an upright mode, the gripping portion extends generally transverse to the forearm of the user. The handle can then be gripped by the user so that the hand, wrist and lower arm are in alignment and are not twisted as in the conventional arrangement. The vacuum cleaner can then be moved backwards and forwards over the surface to be cleaned in the normal way but this is achieved by a "sawing" action which produces less strain on the wrist and is more comfortable for the user.

The gripping portion, preferably, extends forwardly and downwardly at an acute angle to the longitudinal axis of the handle portion so that, in use, the gripping portion is approximately horizontal which causes less twist on the wrist and hence less strain.

The rigid pipe portion of the above mentioned vacuum cleaner comprises a hollow tube into which objects can drop and possibly cause a blockage. Furthermore, improper use of the wand can cause injury and any domestic appliance is at risk of improper use, for example, by children. The exposed open end of the rigid pipe portion of the wand can be particularly dangerous.

Therefore, the present invention further seeks to overcome these disadvantages by providing a handle for a vacuum cleaner comprising a rigid pipe portion connected to a flexible hose portion, the hose portion being fixedly connected to the main body of the vacuum cleaner, the pipe portion being selectively connectable to the main body of the vacuum cleaner in the manner of a handle or releasable from the main body in the manner of a wand, characterized in that a cap is provided at the distal end of the pipe portion, the cap being movable between a first position in which the end of the pipe portion is closed by the cap and a second position in which the end of the pipe portion is not closed by the cap.

The closure of the distal end of the pipe portion by the cap helps to prevent objects dropping into the pipe and to minimise the risk of injuries through improper use.

Preferably, the cap is pivotally attached to the pipe portion.

The wand may comprise a device for hanging the vacuum cleaner from a wall so that the vacuum cleaner can be easily stored away. The hanging device may be in the form of a hook and may also be integral with the cap.

BRIEF DESCRIPTION OF THE DRAWINGS

An embodiment of the invention will now be described and fully explained with reference to the accompanying drawings, wherein.

DETAILED DESCRIPTION OF THE INVENTION

Figures 1, 2:
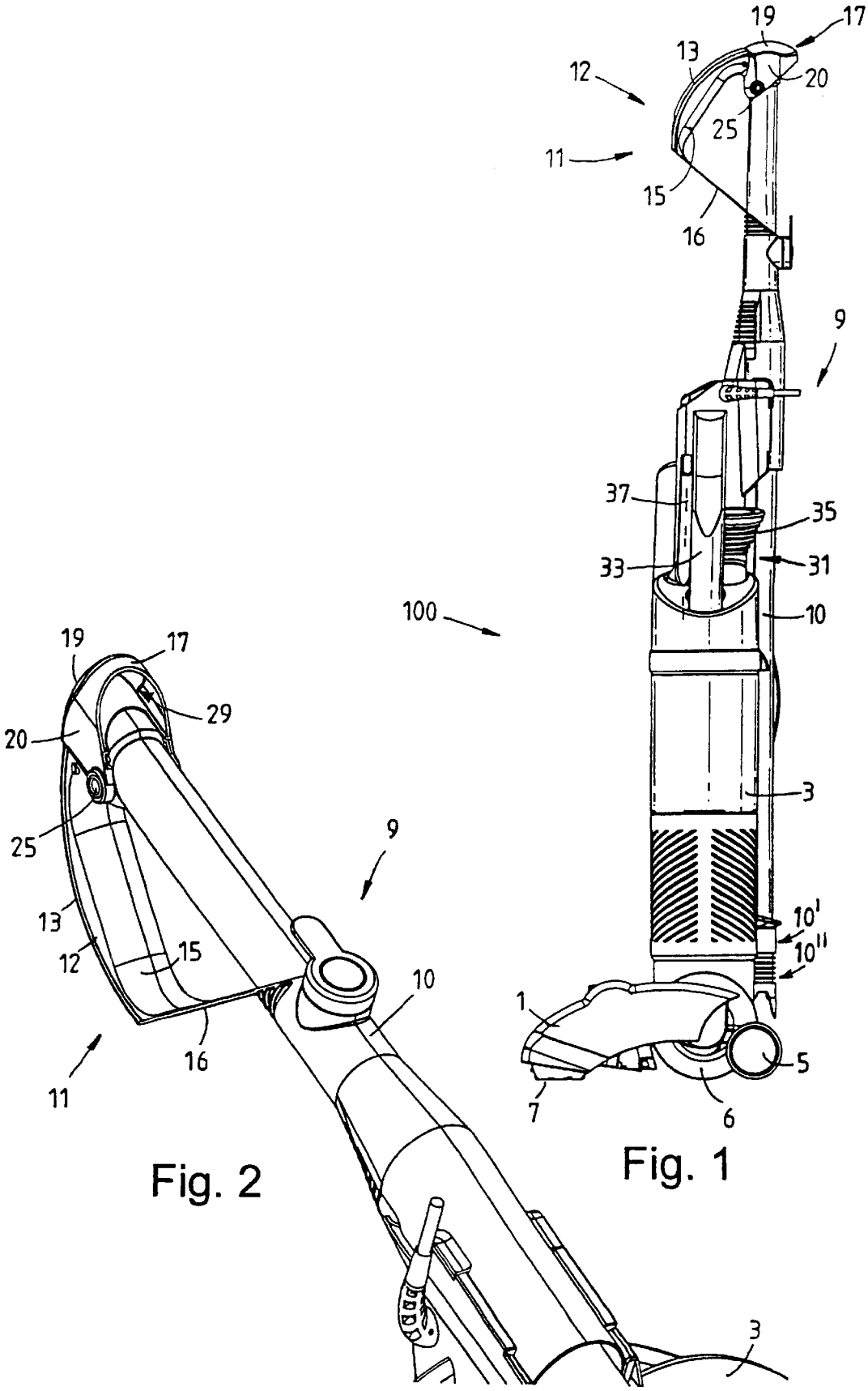
FIG. 1 illustrates a vacuum cleaner having a handle according to an embodiment of the present invention.
FIG. 2 shows a perspective view of the handle, of FIG. 1.

The present invention will now be described in more detail with reference to FIGS. 1 to 4.

The vacuum cleaner 100 comprises a cleaner head 1 rotatably mounted to the lower end of the main body 3 of the vacuum cleaner 100. The main body 3 houses dust separating apparatus in the form of a dust bag, cyclonic separator, etc. A pair of wheels 5 are also mounted at the lower end of the main body 3 via a motor casing 6 from which the cleaner head 1 extends in a forward direction.

The cleaner head 1 has a dirty air inlet 7 located at its forward end and facing downwardly so that, in use in an upright mode, the dirty air inlet 7 contacts a surface to be cleaned and dirty air enters the cleaner head I via the dirty air inlet 7 before being conducted to the dust separating apparatus (not shown). A wand 9 is releasably attached to the rear side of the main body 3 of the vacuum cleaner 100. The wand 9 can be detached from the main body 3 of the vacuum cleaner 100 and extended for use in a cylinder mode in which the distal end of the wand 9 becomes the active dirty air inlet. Means are provided for shutting off the dirty air inlet in the cleaner head 1 when it is used in the cylinder mode.

The wand 9 comprises a rigid pipe portion 10 and a flexible hose portion 10". The proximal end 10' of the rigid pipe portion 10 is slidably and releasably connected to one end of a flexible hose portion 10" to allow telescopic sliding of the pipe portion 10 within the hose portion. The other end of the flexible hose portion 10" is fixedly connected to the lower end of the main body 3 of the vacuum cleaner. The pipe portion 10 and hose portion together provide an air flow path into the dust separation apparatus when the vacuum cleaner is used in a cylinder mode. The pipe portion 10 of the wand 9 consists of a straight, hollow tube having no internal bends. This reduces the risk of blockage and also allows the user to look down the pipe 10 in case of a blockage and to remove the blockage by introducing an elongate tool into the pipe portion from one end. The absence of any internal bends allows this.

The pipe portion 10 extends upwardly from the main body of the vacuum cleaner to form a handle 11 when the vacuum cleaner 100 is to be used in its upright mode. The handle 11 comprises a gripping portion 12 which extends forwardly and downwardly from the distal end of the pipe portion 10 at an acute angle to the longitudinal axis of the pipe portion 10. The gripping portion 12 comprises an outer portion 13 having a curved outer surface and an inner portion 15. The gripping portion 12 is shaped so as to be comfortable for a user gripping the gripping portion 12. A lower portion 16 of the handle 11 extends from the forward end of the gripping portion 12 downwardly and rearwardly to attach the gripping portion 12 of the handle 11 to the pipe portion at a point approximately midway between the distal end of the pipe portion 10 and the top of the main body 3 of the vacuum cleaner 100. The lower portion 16 braces the gripping portion and provides strength and stability thereto.

In the upright cleaning mode, the wand 9 is clipped to the main body 3 of the vacuum cleaner 100 so that the rigid pipe portion 10 extends upwardly from the main body 3 as shown in the FIGS. The gripping portion 12 of the handle 11 is grasped by the user and the main body 3 of the vacuum cleaner 100 is tilted rearwardly towards the user and away from the cleaner head 1. In this position, the pipe portion 10 lies beneath the gripping portion 12 and the gripping portion 12 is approximately horizontal. The user moves the vacuum cleaner in a forward and backward direction over the surface to be cleaned. This corresponds to a "sawing" action and the hand, wrist and lower arm of the user are in alignment, which causes less strain on the wrist than many known arrangements. The main body 3 of the vacuum cleaner 100 can be laid flat on the ground. In this horizontal position, the gripping portion 12 extends upwardly from the pipe portion 10 and, therefore, the vacuum cleaner can easily be lifted by grasping the gripping portion 12. This is advantageous for elderly and disabled users.

Figure 3:
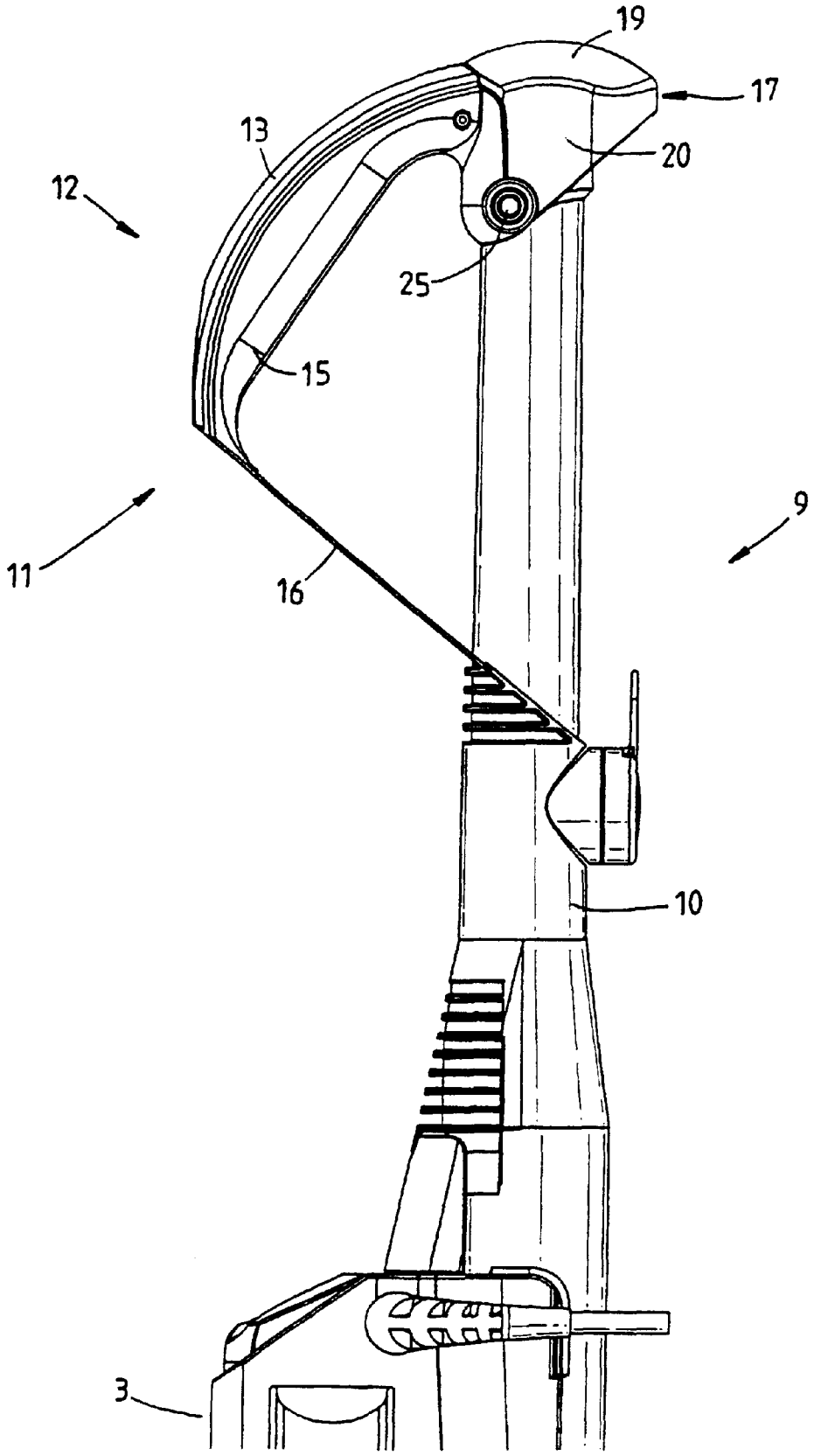
FIG. 3 shows a side view of the handle, of FIG. 1 with the cap shown in the closed position.
Figure 4:
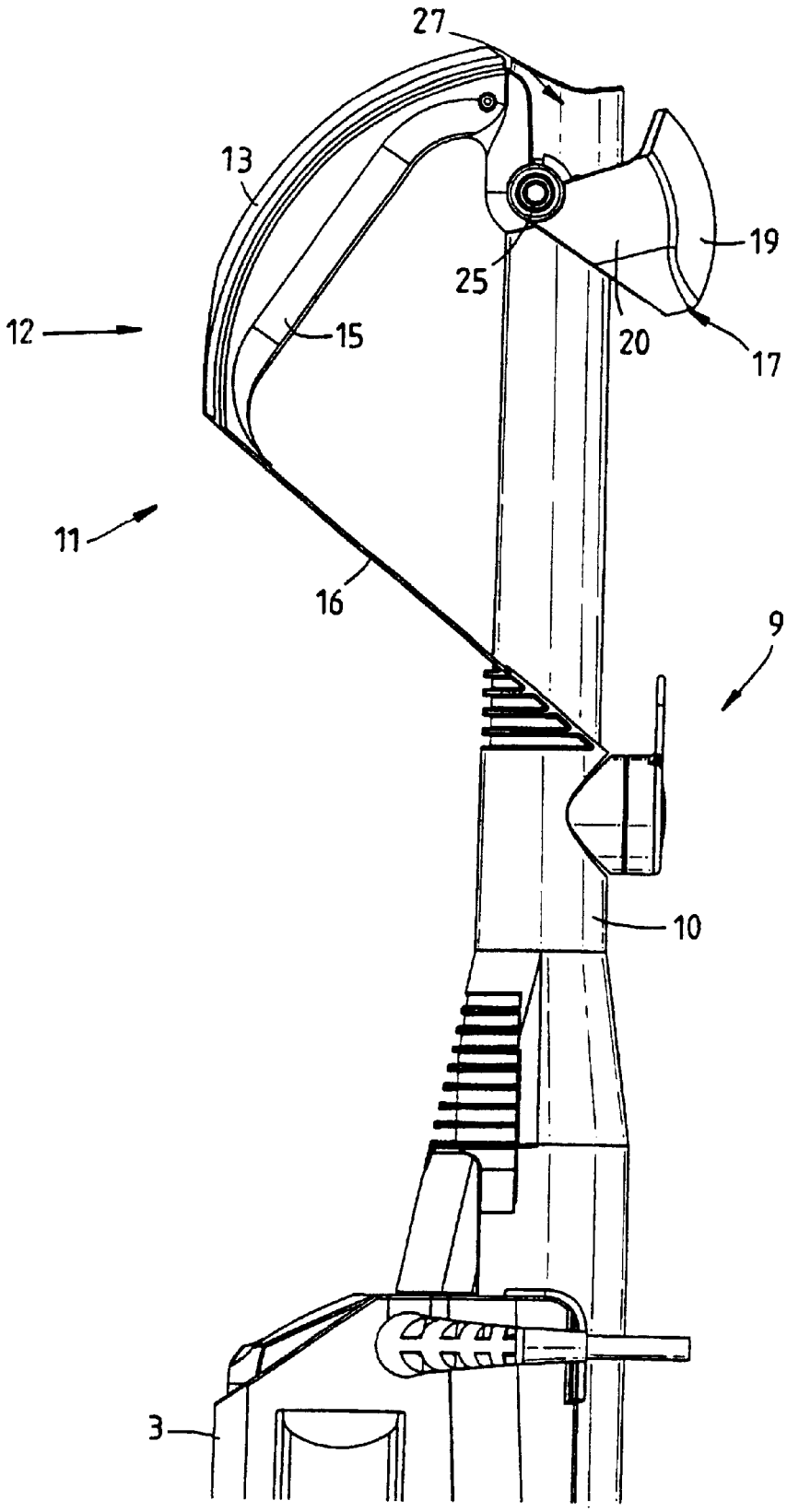
FIG. 4 shows a side view of the handle, of FIG. 1 with the cap shown in its open position.

A cap 17 is pivotably attached to the distal end of the pipe portion 10 at a pivot point 25 on either side of the pipe portion 10. The pivot points 25 are located beneath the point at which the gripping portion 12 is attached to the pipe portion 10. The cap 17 comprises an outer curved surface 19 remote from the pivot points 25 and two side walls 20. The side walls 20 each extend downwardly from the curved surface 19 to the respective pivot point 25 on either side of the rigid pipe portion 10. The outer curved surface 19 is longer than the end of the pipe portion 10 so that, when in the closed position illustrated in FIG. 3, the curved surface 19 extends rearwardly over the top of the distal end 27 of the pipe portion 10 and beyond the pipe portion 10 to form a recess 29 which forms a hook for hanging the vacuum cleaner on a wall. Biasing means (not shown) such as a spring or resilient strip, urge the cap 17 into the closed position. The cap 17 in its closed position, as shown in FIG. 3, covers the remote end of the wand 9 to prevent objects dropping down into the wand 9 and also to reduce the risk of injury through improper use. The hook 29 enables the vacuum cleaner 100 to be hung from a wall.

In the cylinder mode, the wand 9 is released from the main body 3 of the vacuum cleaner 100. The cap 17 is tilted rearwardly away from the open, distal end 27 of the wand 9 to expose the dirty air inlet. Accessory tools 31 can then be attached to the wand 9. The accessory tools 31 may include a nozzle 33, a circular brush 35 or a crevice tool 37. Attaching a tool, as required, to the open end 27 of the wand 9 forms the dirty air inlet of the vacuum cleaner 100 and retains the cap 17 in the open position.

The accessory tools 31 can be stored on top of the dust separating apparatus of the vacuum cleaner 100 so that they are easily accessible. Alternatively, they can be stored on top of the cleaner head 1. The tools 31 may be stored on corresponding sockets or pegs or held by clips.

In the light of this disclosure, modifications of the described embodiments as well as other embodiments, all within the scope of the appended claims will now become apparent to a person skilled in the art.

What is claimed is:

1. A vacuum cleaner, comprising:

a body;

a separating apparatus housed in the body;

a cleaner head rotatably mounted on the body; and a wand comprising a flexible hose having a first end and a second end, the first end of the flexible hose being fixedly connected to the body, and a rigid pipe portion having a first end and a second end, the second end of the flexible hose being slidably connected to said pipe portion, the rigid pipe portion formed by a straight, hollow tube having no internal bends, wherein the first end of the rigid pipe portion is releasably connected to the body such that the second end of the rigid pipe portion extends upwardly from the body so as to form a handle of the vacuum cleaner when the vacuum cleaner is used in a first mode, and wherein the first end of the rigid pipe portion is configured to be released from the body such that the second end of the rigid pipe portion forms an airflow inlet when the vacuum cleaner is used in a second mode.

2. The vacuum cleaner according to claim 1, wherein the pipe portion comprises a handle portion at the second end of said pipe portion and a gripping portion extending forwardly and downwardly from the second end of said pipe portion.

3. The vacuum cleaner according to claim 2, wherein the gripping portion extends forwardly and downwardly at an acute angle to a longitudinal axis of the handle portion.

4. The vacuum cleaner according to claim 1, further comprising a cap located at the second end of the pipe portion, the cap being movable between a first position in which the second end of the pipe portion is closed by the cap and a second position in which the second end of the pipe portion is not closed by the cap.

5. The vacuum cleaner according to claim 4, wherein the cap is pivotably attached to the pipe portion.

6. The vacuum cleaner according to claim 4, wherein the cap is biased into one of the first and second positions.

7. The vacuum cleaner according to claim 6, wherein the cap is biased into the first position.

8. The vacuum cleaner according to claim 4, wherein the cap incorporates hook means for allowing the vacuum cleaner to be hung up.

9. A handle for a vacuum cleaner comprising a rigid pipe portion connected to a flexible hose portion at a proximal end, the flexible hose portion being fixedly connected to a main body of a vacuum cleaner, the pipe portion being selectively connectable to the main body of the vacuum cleaner as a handle attached to the main body or as a wand when released from the main body, and a cap located at a distal end of the pipe portion, the cap being movable between a first position in which the distal end of the pipe portion is closed by the cap and a second position in which the distal end of the pipe portion is not closed by the cap.

10. The vacuum cleaner according to claim 9, wherein the cap is pivotably attached to the pipe portion.

11. The vacuum cleaner according to claim 9, wherein the cap is biased into one of the first and second positions.

12. The vacuum cleaner according to claim 9, wherein the cap incorporates hook means for allowing the vacuum cleaner to be hung up.

* * * * *